United States Patent [19]

Mazzorana

[11] Patent Number: 4,662,233

[45] Date of Patent: May 5, 1987

[54] ELECTRIC REDUCTION GEAR STARTER FOR INTERNAL COMBUSTION ENGINE

[75] Inventor: Alfred B. Mazzorana, Venissieux, France

[73] Assignee: Societe de Paris et Du Rhone, Lyons, France

[21] Appl. No.: 794,786

[22] Filed: Nov. 4, 1985

[30] Foreign Application Priority Data

Nov. 6, 1984 [FR] France ..... 84 17331

[51] Int. Cl.[4] ..... F02N 15/06

[52] U.S. Cl. ..... 74/7 A; 74/7 R; 74/661; 290/38 R

[58] Field of Search ..... 74/7 R, 7 A, 7 E, 6, 74/661; 290/4 R, 4 C, 38 R; 318/12, 13, 9, 45, 91, 94

[56] References Cited

U.S. PATENT DOCUMENTS

| | | | |
|---|---|---|---|
| 1,290,472 | 1/1919 | Zimmerman | 74/7 E |
| 1,396,695 | 11/1921 | Whitney | 74/7 A |
| 1,511,342 | 10/1924 | James | 318/45 |
| 1,822,673 | 9/1931 | Schwenke | 74/6 |
| 2,002,561 | 5/1935 | Wike | 74/7 A |
| 2,017,870 | 10/1935 | Prescott | 74/7 A |
| 2,115,671 | 4/1938 | Pfister | 290/38 R |
| 2,203,795 | 6/1940 | Nardone | 74/7 A |
| 4,573,364 | 3/1986 | Givan | 74/7 E |
| 4,586,467 | 5/1986 | Raver | 74/7 A |
| 4,592,243 | 6/1986 | Katoh et al. | 74/7 R |

FOREIGN PATENT DOCUMENTS

| | | | |
|---|---|---|---|
| 2436264 | 5/1980 | France | 74/7 R |

*Primary Examiner*—Cornelius J. Husar
*Assistant Examiner*—Peter M. Cuomo
*Attorney, Agent, or Firm*—Browdy and Neimark

[57] ABSTRACT

A starter includes two electric drive motors (1, 2), with parallel axes (3, 4), coupled to the same reduction gear (11, 14) whose output shaft (15) is connected to a single Bendix starter (18). Shaft (6) of one of the motors (1) exhibits a reversible thread (23) on which is mounted a nut pinion (7), engaged with a gear wheel (11) of the reduction gear and further connected to control lever (27), which is connected to Bendix starter (18). When first electric motor (1) is started, nut pinion (7) is braked in rotation by passive resistances, and therefore moved axially, which, by lever (27), causes the advance of Bendix starter (18), bringing pinion (21) of the latter to engage with ring gear (22) of the internal combustion engine.

13 Claims, 4 Drawing Figures

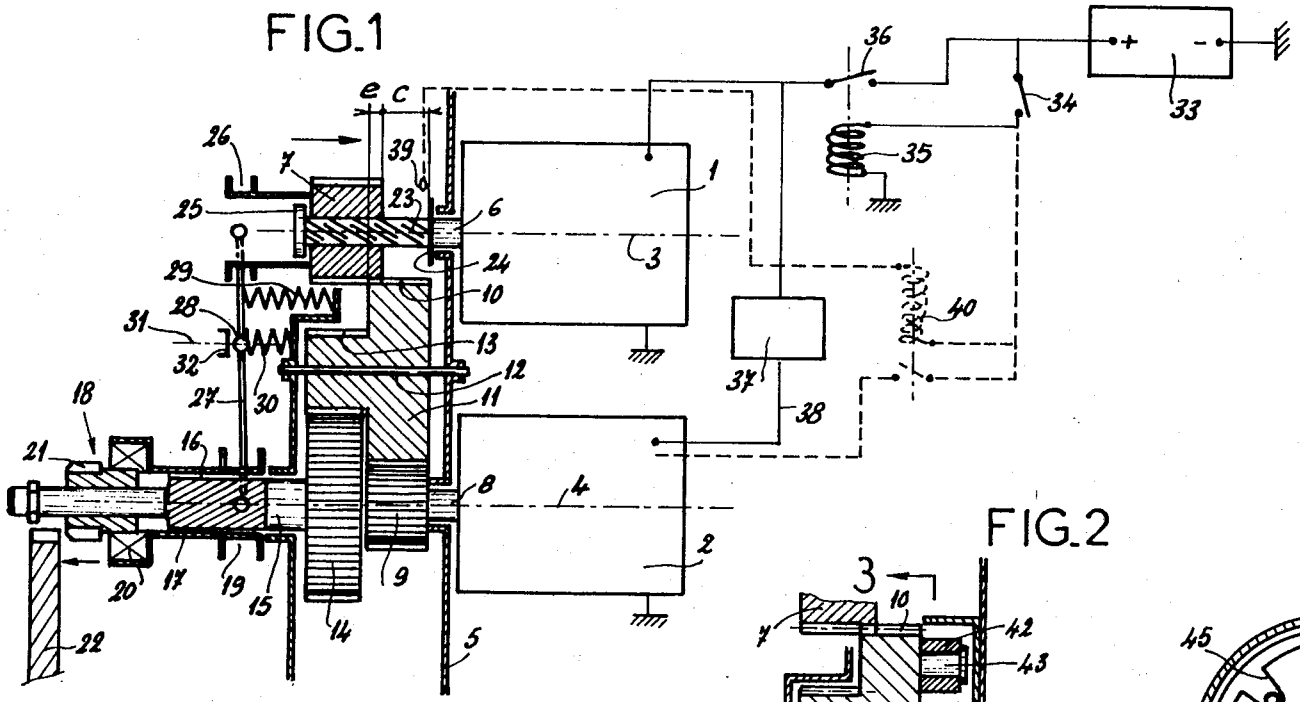
FIG.1
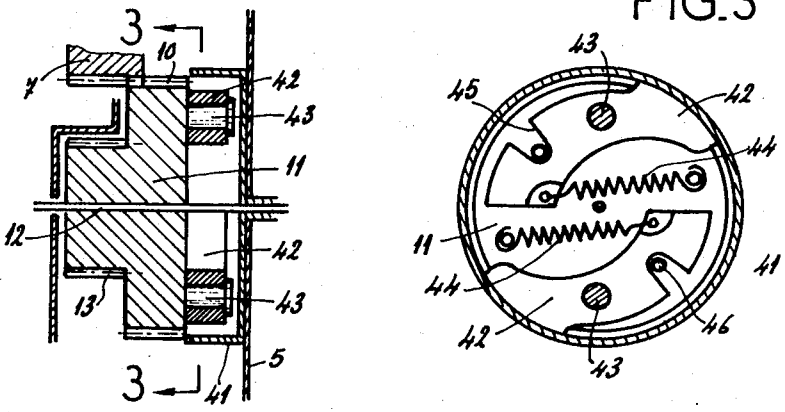
FIG.2
FIG.3

ELECTRIC REDUCTION GEAR STARTER FOR INTERNAL COMBUSTION ENGINE

The invention relates to an electric starter, of the reduction gear type, for an internal combustion engine and particularly for a motor vehicle engine.

In a standard electric starter, an electric motor fed direct current is provided to be coupled to a starting ring gear coupled to an internal combustion engine, by means of a meshing mechanism comprising an electromagnetic actuator which controls a lever connected to a device called a "Bendix starter" made up of a pinion engaging with the ring gear, and a freewheel driver. When its solenoid is energized, the electromagnetic actuator, by the lever and driver, causes the axial movement of the Bendix starter pinion bringing this latter into engagement with the ring gear. Simultaneously the actuator closes the electric contacts assuring feeding of the electric motor of the starter, which puts the pinion in rotation.

Embodiments have also been proposed in which the meshing control lever has its movement controlled by an auxiliary electric motor—see French Pat. No. 2,444,167 in the name of the applicant. The auxiliary electric motor there replaces only the electromagnetic actuator and has no function of putting the Bendix starter in rotation.

In some starters, a reduction transmission is inserted between the electric drive motor of the starter and the Bendix starter, which makes it possible to increase the power-to-weight ratio of the electric motor while increasing its speed.

Further, to increase the power in a compact embodiment, it is also known, according to French Pat. No. 2,526,087 in the name of the applicant, to make a reduction gear starter which comprises at least two electric drive motors with parallel axes, which are mechanically coupled to the same reduction gear whose output shaft is connected to a single Bendix starter device, wherein the pinion engages the ring gear of the internal combustion engine. The two electric motors of this starter are electrically coupled to function simultaneously, so that their powers are combined to place the Bendix starter in rotation.

This two-motor electric starter retains a standard electromagnetic actuator, placed parallel to the two motors and controlling a lever by means of which the Bendix starter is moved axially.

OBJECTS AND SUMMARY OF THE PRESENT INVENTION

The present invention as its primary object the simplification of this type of starter having two electric motors, by using one of the motors to also perform the function of an electromagnetic actuator, therefore eliminating the actuator.

For this purpose, in the electric reduction gear starter of the invention, one of the electric drive motors is connected in rotation with an element comprising a helical connection with a pinion engaged with a toothed element of the reduction gear, the pinion further being connected to a control lever that is connected to the Bendix starter, so that on starting of the electric motor, a braking in rotation of the pinion causes its axial movement and, by the lever, controls the advance of the Bendix starter bringing the pinion of the latter in to engagement with the ring gear. Thereafter, the starter pinion is driven in rotation by the two electric motors.

The pinion driven by the first electric motor is, for example, a nut with an internal thread, while the element comprising the helical connection is simply the shaft of the electric motor with a reversible thread complementary to the inside thread of the nut pinion, and a stop limiting the axial movement of the nut pinion.

As the first electric motor is started, passive resistance (e.g. friction, inertias, multiplying reverse effects of the pinions of the reduction gear, braking of the rotor of the second electric motor if the latter is of the magnet type) cause the pinion at first to remain immobile in rotation and only move axially toward the stop of the shaft of the first motor. The axial movement of the pinion associated with the first motor causes the advance of the Bendix starter and then causes the pinion of the Bendix starter to engage with the ring gear. From movement that of the pinion associated with the first motor strikes the stop, its screwing movement is halted and the pinion is driven positively in rotation to transmit all the power of the first electric motor to the reduction gear.

The effect of the initial braking of the pinion driven by the first electric motor and used to control the advance of the Bendix starter can be boosted, if necessary, by providing centrifugal-action braking and unlocking mechanical means associated with a gear wheel of the reduction gear or the pinion associated with the second electric motor.

The electric starter according to the invention also performs this meshing function using only the power of one or two electric drive motors and a meshing control lever. The usual electromagnetic actuator is entirely eliminated, resulting in a saving and a certain gain in size for a starter of given power.

After engagement of the pinion of the Bendix starter and the ring gear of the internal combustion engine, the powers of the two electric motors are combined to assure driving of the Bendix starter in rotation. The second electric motor, i.e., the one that does not intervene directly for control of the meshing, is fed with a certain delay in comparison with the first electric motor either by an outside delay circuit inserted in its feed circuit or by a relay energized from an end-of-travel contact associated with the pinion moved by the first motor or with an element connected to this pinion, such as the lever or Bendix starter.

To stop the starter, the two electric motors have their feed cut off simultaneously. A return spring, associated with the pinion moved by the first motor or with an element connected with this pinion (such as the lever), brings the pinion to its initial position, away from its stop.

BRIEF DESCRIPTION OF THE DRAWINGS

The invention will be better understood with the help of the following detailed description, and with reference to the accompanying drawings representing, by way of nonlimiting example, an embodiment of the electric reduction gear starter of the present invention, in which;

FIG. 1 is a sectional illustration of a starter according to the invention with its electric feed circuits;

FIG. 2 is a detailed sectional view corresponding to a part of FIG. 1 and illustrating a variant thoreof;

FIG. 3 is a view in section relating to this variant, taken along section line 3—3 of FIG. 2.

DETAILED DESCRIPTION OF THE INVENTION

Figure 4:
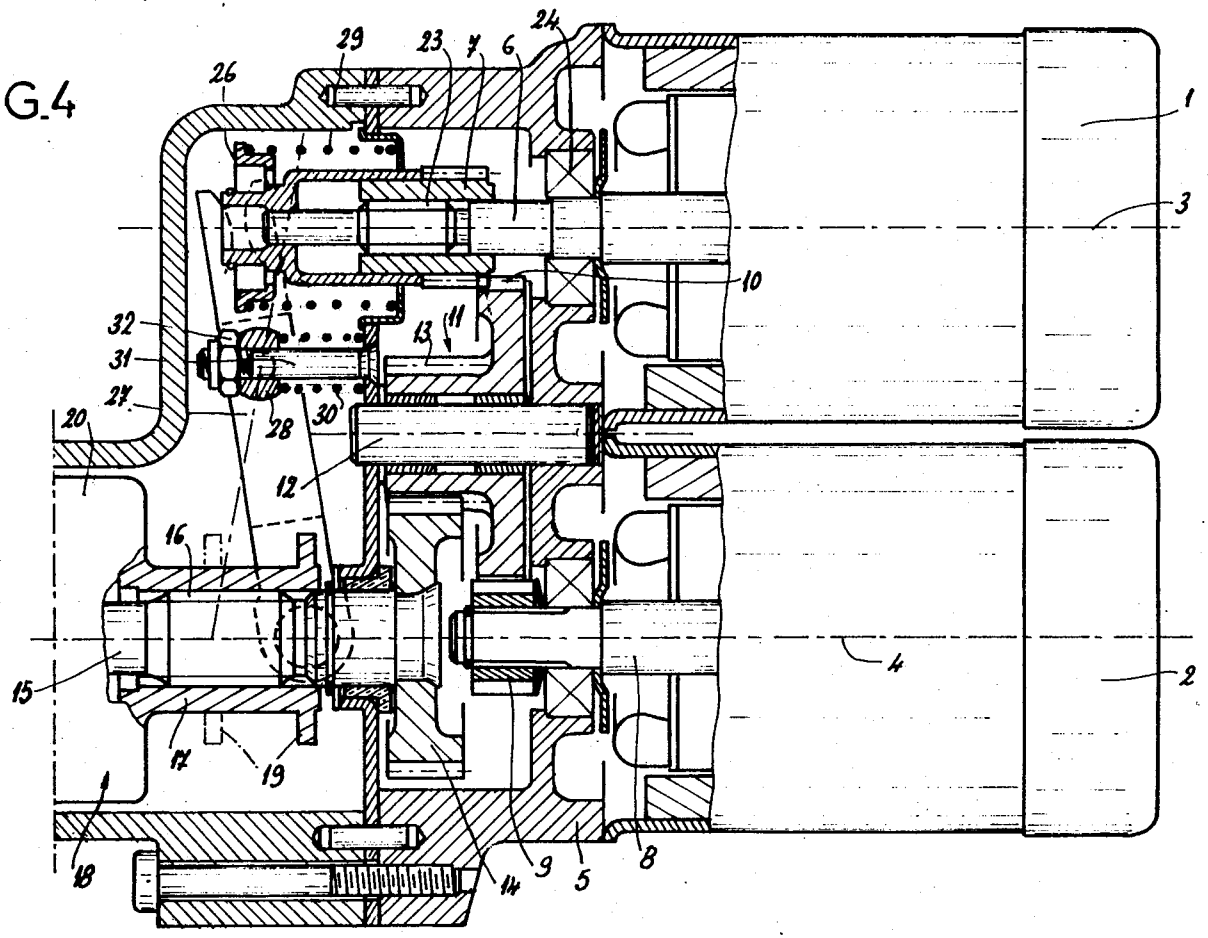
FIG. 4 is a side view, in partial section, of a particular embodiment of the starter according to the invention.

The starter, represented diagrammatically in FIG. 1, and in greater detail in FIG. 4, comprises a first electric motor (1) and a second electric motor (2), with parallel axes (3,4), mounted on the same side of a common support flange (5). Shaft (6) of first electric motor (1) carries a first pinion (7). Shaft (8) of second electric motor (2) carries a second pinion (9). The two pinions (7, 9) are engaged with one of the gearings (10) of a two-stage gear wheel (11), mounted idle on a shaft (12) fastened to support flange (5) between the two axes (3, 4). The second gearing (13) of gear wheel (11) is engaged with another gear wheel (14) solid with a shaft (15) coaxial with the shaft (8) of second electric motor (2). The group of pinions (7, 9) and gear wheels (11, 14) constitutes a reduction transmission.

Output shaft (15) of the reduction gear comprises, in a standard way, helical grooves (16) in which is mounted driver (17) of Bendix starter (18), provided with a control groove or cheek (19) and a freewheel (20) connecting it to pinion (21) of Bendix starter (18), and intended to engage a ring gear (22) of the internal combustion engine.

Shaft (6) of first electric motor (1) exhibits a reversed thread (23) making a helical connection with pinion (7) which is shaped as a nut with a complementary thread. Nut pinion (7) is thus able to move axially on shaft (6). Nut pinion (7) is permanently engaged with gearing (10) of gear wheel (11), at least over a short length (e), and can describe a total travel (C) bringing it from its position farthest from stop (24) into contact with the stop (24) (see FIG. 1).

Nut pinion (7) is connected axially to a control rim or cup (26). A meshing control lever (27), hinged at an intermediate point on a shaft or support (28), has its first end connected to control rim or cup (26) associated with nut pinion (7), while its second end is connected to control groove or cheek (19) of driver (17) of Bendix starter (18).

A return spring (29) acts either on control lever (27) (see FIG. 1) or on control rim or cut (26) (FIG. 4) to bring and maintain the mobile unit made up of nut pinion (7), lever (27) and Bendix starter (18) into rest position. The meshing control lever also comprises a spring called a "tooth to tooth" spring (30) intervening in case of a striking of the gearing of pinion (21) of Bendix starter (18) against the gearing of ring gear (22) which would prevent an immediate engagement of the two gearings. In the embodiment represented, the shaft or support (28) of lever (27) is mounted to slide on a guide (31) parallel to axes (3, 4), and the "tooth to tooth" spring (30) normally thrusts shaft or support (28) against a stop (32) opposing its sliding.

At the time starting is to be performed, first electric motor (1) is fed first to cause the advance of Bendix starter (18) bringing pinion (21) to engage with gear ring (22), the functioning being established as follows:

Energizing of electric motor (1) puts shaft (6) of this motor in rotation. At this moment, the various passive resistances cause nut pinion (7) to remain immobile in rotation and, by virtue of its helical connection with shaft (6), it moves in the axial direction on this shaft, in the direction of arrow (F) of FIG. 1. In describing its total travel (C), nut pinion (7) actuates control lever (27) against the action of return spring (29); pivoting of lever (27) around shaft or support (28) causes the advance of Bendix starter (18) on shaft (15), thereby resulting in the engagement of pinion (21) with ring gear (22).

Starting from the moment of reaching end-of-travel (C), nut pinion (7) is axially stopped by stop (24), and shaft (6) of the first electric motor (1) positively drives nut pinion (7) in rotation, so as to transmit its torque to gear wheel (11) which transmits it to gear wheel (14), shaft (15) and Bendix starter (18).

At this moment, the second electric motor (2) is also fed, and it also transmits its torque to gear wheel (11) by pinion (9). Thus the torques and powers of the two electric motors (1, 2) are combined for driving the Bendix starter (18) in rotation.

For nut pinion (7) effectively to come in contact with stop (24), when pinion (21) of Bendix starter (18) also comes on its usual stop (not shown) on shaft (15), it is advisable to make sets suitable for the various mechanical connections existing in the kinematic chain consisting of control rim or cup (26), lever (27), shaft or support (28) and control groove or cheek (19).

In case of "tooth against tooth" striking, there are two possibilities which can be used separately or simultaneously: First, "tooth against tooth" spring (30) can be compressed; and, second, shaft (15) can be rotated under reduced torque. This latter possibility can occur due to the fact that nut pinion (7) is unable to move axially any further and is forced to rotate.

For stopping of the starter, after starting the internal combustion engine, feeds of the two electric motor (1, 2) are cut off simultaneously. Return spring (29) then returns nut pinion (7), lever (27) and Bendix starter (18) to their start position (indicated in FIG. 1 and corresponding to the solid line of FIG. 4).

The two electric motors (1, 2) can be identical or different, the combination of two motors of different power, in some cases, being capable of obtaining the desired total power from available motors.

As indicated in FIG. 1, the two electric motors (1, 2) are fed in parallel from battery (33) of the motor vehicle by switch key (34). First electric motor (1) is fed as soon as switch key (34) is closed by a relay (35) controlling a power contact (36). For delayed feeding of the second electric motor (2), an outside delay circuit (37) can be inserted in feed circuit (38) for the second motor (2).

The dotted line of FIG. 1 shows a variation in which starting of second electric motor (2) is controlled by an end-of-travel contact (39), actuated either by nut pinion (7) when it has described its entire travel (C) or by any other element, such as lever (27) or Bendix starter (18), whose movement is linked to that of nut pinion (7). End-of-travel contact (39) makes possible the feeding of the second motor (2) by another relay (40), with delay circuit (37) and circuit (38) being eliminated.

As shown in FIGS. 2 and 3, initial braking of nut pinion (7) can be boosted by a centrifugal unlocking device, here shown associated with two-stage gear wheel (11) of the reduction gear. A stationary drum (41) is mounted concentrically around shaft (12) of this gear wheel (11) acting as a track with two or more flyweights (42) hinged on the respective shafts (43) installed on a face of gear wheel (11). Flyweights (42) are applied against drum (41) by the respective springs (44). Each flyweight (42) exhibits a cutout (45) whose bottom can rest on a stop (46) solid with gear wheel (11).

The force of springs (44) is set so that the effect on gear wheel (11) of the friction of flyweights (42) against drum (41) is largely sufficient to oppose the friction torque of nut pinion (7) on thread (23) of shaft (6) so that driving of nut pinion (7) in rotation is prevented. When nut pinion (7) comes against stop (24), the torque transmitted by the first electric motor (1) becomes greater than the braking torque, and gear wheel (11 starts to rotate fast enough for flyweights (42) to pivot on shafts (43), under the effect of the centrifugal force, against the actions of springs (44). Flyweights (42) then are no longer applied against drum (41); their pivoting is limited by stops (46), which hold them in a position assuring a good dynamic balancing of the revolving unit.

The centrifugal unlocking device could also be associated with another gear wheel (14) of the reduction gear, or also with pinion (9) associated with the second electric motor (2), while functioning according to the same principle and with the same effect.

The present invention is not limited to the single embodiment of the reduction gear electric starter just been described above; on the contrary, all variants in design and application employing the same principle are contemplated. Thus, particularly, the invention could also be used on a starter provided with a reduction gear of a different structure, for example, a reduction gear with more or less numerous stages or a gain reduction gear of the epicyclic type.

What is claimed is:

1. Electric reduction gear starter apparatus for an internal combustion engine including first and second electric drive motors having parallel rotatable output shafts mechanically coupled to a single reduction gear, said reduction gear including an output shaft connected to a single Bendix starter having pinion means engagable with a ring gear of the internal combustion engine, said apparatus comprising:

a first pinion mounted on the motor output shaft of said first motor, and a second pinion mounted on the motor output shaft of said second motor, said first motor output shaft having a predetermined length including reversed helical threads cooperating with said first pinion to permit translation of said first pinion on, and relative to, said first motor output shaft, said first pinion further being in engagement with said reduction gear while translating, along said length of said first motor output shaft, between a first position and a second position , said second position terminating further translation of said first pinion along said first motor output shaft and initiating rotation of said first pinion with said first motor output shaft via said threads so that said reduction gear may be driven in rotation, centrally pivotable control lever means having one end coupled to said first pinion and a second, opposite end coupled to said Bendix starter, and means for actuating said second electric motor when said first pinion reaches said second position so that said second pinion can additionally drive said reduction gear in rotation, whereby on actuation of said first electric motor, rotation of the output thereof causes said first pinion to translate on said shaft from said first position to said second position so that said control lever means advances said Bendix starter into engagement with said ring gear, and subsequently said second electric motor is actuated to cause said second pinion to drive said reduction gear in rotation, whereupon said first pinion, together with said second pinion, rotatably drive said reduction gear and aid Bendix starter to turn said ring gear of said internal combustion engine.

2. The apparatus of claim 1, wherein said first pinion comprises internal threads complementarily configured with said first motor output shaft threads for engagement therewith, and said second position comprises stop means for limiting translation of said pinion on said first motor output shaft.

3. The apparatus of claim 2, herein a control rim is connected axially to said first pinion, and said Bendix starter includes a control groove, said control lever means one end being engaged with said control rim and said control lever means opposite end being engaged with said control groove.

4. The apparatus of claim 1, and further including centrifugal braking and unlocking means for contributing to the braking of said first pinion driven by said first electric motor to control the advance of said Bendix starter, said braking and unlocking means being associated with at least a second pinion associated with said second electric motor.

5. The apparatus of claim 2, and further including centrifugal braking and unlocking means for contributing to the braking of said first pinion driven by said first electric motor to control the advance of said Bendix starter, said braking and unlocking means being associated with at least a second pinion associated with said second electric motor.

6. The apparatus of claim 3, and further including centrifugal braking and unlocking means for contributing to the braking of said first pinion driven by said first electric motor to control the advance of said Bendix starter, said braking and unlocking means being associated with at least a second pinion associated with said second electric motor.

7. The apparatus of claim 4, wherein said braking and unlocking means comprises a stationary drum, and flyweights hinged on said gear wheel of the reduction gear, each flyweight engageable against said drum by a spring.

8. The apparatus of claim 4, wherein said braking and unlocking means comprises a stationary drum, and flyweights hinged on said second pinion, each flyweight being engageable against said drum by a spring.

9. The apparatus of claim 1, wherein said reduction gear comprises a two-stage gear wheel including a first gearing and a second gearing, and said first pinion associated with said first electric motor and used for controlling the advance of said Bendix starter, is engaged with said first gearing of said two-stage gear wheel, said first gearing being also engaged with a pinion associated with the second electric motor, said second gearing of said two-stage gear wheel being engaged with another gear wheel solid with a shaft connected to said Bendix starter.

10. The apparatus of claim 1, wherein the output shaft of said reduction gear is coaxial with the shaft of said second electric motor.

11. The apparatus of claim 1, wherein said second electric motor is fed, with a certain delay in relation to said first electric motor, by an outside delay circuit inserted in a feed circuit of said second electric motor.

12. The apparatus of claim 1, wherein said second electric motor is fed, with a certain delay in comparison with said first electric motor, by a relay energized from an end-of-travel contact associated with said first pinion moved by said first electric motor.

13. The apparatus of claim 1, wherein said means for actuating said second electric motor includes means for delaying, for a predetermined time following the starting of said first electric motor, the starting of said second electric motor.

* * * * *